US006154903A

United States Patent [19]

Wai-Chung

[11] Patent Number: 6,154,903

[45] **Date of Patent: *Dec. 5, 2000**

[54] BODY REST STRUCTURES

[76] Inventor: Patrick Wai-Chung, 1535 Ostler Court, North Vancouver, BC, Canada, V7G 2P1

[ * ] Notice: This patent issued on a continued prosecution application filed under 37 CFR 1.53(d), and is subject to the twenty year patent term provisions of 35 U.S.C. 154(a)(2).

[21] Appl. No.: 09/105,262

[22] Filed: Jun. 26, 1998

Related U.S. Application Data

[63] Continuation-in-part of application No. 08/966,024, Nov. 7, 1997, abandoned.

[51] Int. Cl.[7] ..... A47C 20/00

[52] U.S. Cl. ..... 5/632; 5/638; 5/640; 5/652.1; 5/657

[58] Field of Search ..... 5/630, 632, 638, 5/640, 725, 731, 733, 735, 652, 652.1, 657

[56] References Cited

U.S. PATENT DOCUMENTS

| | | | |
|---|---|---|---|
| 2,182,861 | 12/1939 | Albert | 5/735 X |
| 2,700,779 | 2/1955 | Tolkowsky | 5/636 |
| 3,009,172 | 11/1961 | Eidam | 5/636 X |
| 3,382,510 | 5/1968 | Robinson | 5/638 X |
| 3,747,916 | 7/1973 | Benson | 5/725 |
| 4,054,960 | 10/1977 | Pettit et al. | 5/725 X |
| 4,259,757 | 4/1981 | Watson | 5/640 X |
| 4,473,913 | 10/1984 | Ylvisaker | 5/657 |
| 4,635,306 | 1/1987 | Willey | 5/657 X |
| 4,944,059 | 7/1990 | Wall | 5/431 |
| 5,269,035 | 12/1993 | Hartunian | 5/638 |
| 5,360,017 | 11/1994 | Austin | 5/640 |
| 5,509,153 | 4/1996 | Roschacher | 5/725 X |
| 5,632,050 | 5/1997 | Zajas et al. | 5/638 X |
| 5,642,543 | 7/1997 | Huntley | 5/638 X |
| 5,652,981 | 8/1997 | Singer-Leyton et al. | 5/631 |

FOREIGN PATENT DOCUMENTS

| | | | |
|---|---|---|---|
| WO 97/14342 | 4/1997 | WIPO | A47G 9/00 |

*Primary Examiner*—Michael F. Trettel
*Attorney, Agent, or Firm*—Siemens Patent Services, LC

[57] ABSTRACT

A body rest structure includes a torso support for supporting the torso of a human body in a prone, elevated position which serves to induce a mild stretch of the user's thoracic and lumbar vertebrae. The torso support includes an upper chest and shoulder support platform and a lumbar support platform. An open region extends longitudinally between the platforms to provide room for at least a portion of the weight of the chest below the shoulders to pull down on the body between the platforms. The support may include a rear supporting surface to provide lifting support from below the hips and abdomen of the body. A head support for supporting the head of the body in a downwardly facing position when the torso is supported by the torso support is also disclosed. The head support includes a front portion for providing lifting support to the forehead of the body, and parallel opposed side portions for supporting opposed sides of the face. Each side portion has an upper surface that slopes upwardly from the front portion of the head support to the associated distal end of the side portion.

19 Claims, 6 Drawing Sheets

BODY REST STRUCTURES

This is a continuation-in-part of application Ser. No. 08/966,024, filed Nov. 7, 1997, now abandoned.

FIELD OF THE INVENTION

The present invention relates to body rest or body support structures. In particular the present invention relates to a structure for supporting the torso of a human body in a prone position in manner that serves to relieve and counter the effects of back strain, and to a head support particularly suited for use in conjunction with the torso support.

BACKGROUND TO THE INVENTION

On a normal rest or sleeping surface such as a flat mattress, air cushion or the like, the user will typically lie in a supine position or in a side position. Occasionally, he or she may lie in a prone position but only for relatively short periods of time because the head must be turned sideways in order to breath properly. However, all of these positions impose some strains on various parts of the body. In other words, while one part of the body is effectively at rest, other parts are inevitably under strain. The head, neck, shoulders, back, hip and legs are never evenly supported at the same time. In an effort to remain comfortable, it may be necessary to change positions at relatively frequent intervals.

Some individuals have difficulty sleeping or resting comfortably on any normal surface. One source of such difficulty can be back pain brought on by accumulated compression forces which stress the spine and which may become more noticeable and aggravating with age. Normal resting or sleeping surfaces are not well adapted for the purpose of relieving such stress.

Various body support or body rest structures have been devised to better enable an individual to lie in a prone position. For example, U.S. Pat. No. 4,665,573 (Fiore) granted on May 19, 1987 discloses a contoured mattress the upper surface of which is contoured to retain the spine of an individual in a natural position whether the individual lies in a supine position, a side position or a prone position. However, while retention of the spine in a natural position may serve to relieve some of the accumulated stress which arises from spinal compression, and to do so with more effect than if the individual simply laid on a conventional flat mattress, the effect is nevertheless limited. Further, it appears that the arms of the individual are constrained to find their support of the surface of the contoured mattress. Such a constraint can impose undesirable strain on an individual's arms, shoulders or back and therefore may not contribute to complete rest. Moreover, when in the prone position, its appears that the individual's face is directed into the surface of the mattress thereby compromising the individual's ability to maintain proper breathing while maintaining proper alignment of the neck and cervical vertebrae of the spine.

As another example, U.S. Pat. No. 5,509,153 (Roschacher) granted on Apr. 23, 1996 discloses a mattress which includes an integrally formed torso support and head support for an individual lying in a prone position on the mattress. The primary purpose is to allow unrestricted breathing while tanning one's back. It is incidentally noted that the shape may serve to relieve people suffering from back ache and rheumatism. The torso support portion is slightly elevated above the head support portion and it is noted by Roschacher that this serves to relieve the cervical column and to avoid the occurrence of neck ache. Also, it serves to relieve breathing problems as noted above in the case of Fiore. However, the mere relief of the cervical column which may serve to avoid the occurrence of neck ache is different from a positive action designed to counter the effect of neck ache which may already exist. It is also indicated by Roschacher that the elevated torso support portion of his design results in an unstiffened naturally bent spinal column thereby avoiding back ache. However, not unlike Fiore, the retention of the spine in a natural position will at best have a limited effect on the accumulated stress which arises from spinal compression.

Accordingly, a primary object of the present invention is to provide a new and improved structure for supporting the torso in a manner which not only permits the relief of but also serves to counter the accumulated stress arising from compression of thoracic and lumbar vertebrae in the spine.

A further object of the present invention is to provide a new and improved body rest structure which includes together with such torso support a new and improved head support that not only permits the relief of but also serves to counter the accumulated stress arising from compression of the cervical vertebrae in the spine.

SUMMARY OF THE INVENTION

In one broad aspect of the present invention, there is provided a body rest structure comprising a torso support for supporting the torso of a human body in a prone position elevated above an underlying surface, such torso support including a first side positionable on the underlying surface, and a second side opposed to said first side. When the first side is positioned on the underlying surface, the second side is defined by a first platform for providing lifting support from below the upper chest and shoulders of the body at a first predetermined elevation above the surface and a second platform for providing cooperating lifting support from below the lumbar vertebrae of the body at a second predetermined elevation above the surface. An open region extends longitudinally between the platforms.

In a preferred embodiment, the upper chest and shoulder support platform has an upper surface which extends longitudinally from a front end of the torso support for a relatively short distance and has a width between opposed longitudinally extending sides which width is sized to permit left and right arms of the body to concurrently extend downwardly from the upper surface over associated ones of the platform sides. A means is provided for holding the upper chest and shoulder support platform with its upper surface at an elevation above the underlying surface which permits the neck and head of the body to tilt forwardly and downwardly from the shoulders to a position where the forward end of the chin of the body is in a tucked position above the underlying surface and below the upper surface. The platform and the holding means may be integrally formed as with a block-like construction.

In the preferred embodiment, the longitudinal extension of the lumbar support platform is limited to permit left and right legs of the body to extend downwardly from the platform and longitudinally rearwardly from the rear end of the torso support. A means is provided for holding the lumbar support platform with its upper surface at an elevation above the underlying surface which permits the knees of the legs of the body to rest on the underlying surface without carrying a substantial part of the weight of the legs above the knees. As in the case of the upper chest and shoulder support platform, the lumbar support platform and its holding means may be integrally formed.

Generally, it is contemplated that the two platforms will have approximately the same elevation. However, such a characteristic is not considered essential. For example, for reasons discussed below, it may be desirable in some cases for the lumbar support platform to have an elevation higher than that of the upper chest and shoulder support platform. In other cases, some may prefer that the upper chest and shoulder support platform have an elevation higher than that of the lumbar support platform.

The open region between the platforms provides room for at least a portion of the weight of the chest of the body below the shoulders to pull down on the body between the platforms. The degree to which this desirable function is fulfilled will depend upon the distance between the platforms, body size, and the depth of the opening between the platforms. The open region may be completely open. That is, it may extend downwardly from the platform surfaces to the underlying surface and thus provide no body support across the opening. Alternately, the open region may be relatively shallow. That is, it may have a bottom (above the underlying surface) defined by a sunken or depressed upper surface extending between the upper surface of the upper chest and shoulder support platform and the upper surface of the lumbar support platform. The defining surface is considered sunken or depressed in the sense that at least a substantial portion of the surface extends longitudinally below the elevation of the upper surface of the upper chest and shoulder support platform. If sufficiently shallow, it will serve to limitthe degree to which the body can sag or be pulled down between the platforms, in effect picking up some but not all of the user's sagging weight. Some users may find the support too uncomfortable if the body is permitted to sag without limitation for too long a time between the platforms.

In a limiting case, a shallow open region or depression between the platforms may be primarily designed to provide some support for the breasts of female users. Nevertheless, the depression should not be so shallow as to prevent at least a portion of the weight of the chest, in this case a portion of the weight of the breasts, from effectively pulling down on the body between the platforms.

Preferably, a torso support in accordance with the present invention also includes a rear supporting surface extending downwardly and rearwardly from the upper surface of the lumbar support platform to the rear end of the torso support for providing lifting support from below the hips and abdomen of the body. Concurrently, it serves to direct the user's legs downwardly from the lumbar support platform and longitudinally rearwardly from the rear end of the support. While not considered essential, such support for the hips and abdomen contributes to the user's overall comfort.

As noted above, the upper chest and shoulder support platform and the lumbar support platform may have constructions which are integral with means for holding the upper surfaces of the platforms at desired elevations. In accordance with the present invention, the structure of the torso support may be integrated not only to this limited degree, but also to a more complete degree where the complete structure is fully integrated. However, the present invention is not considered to be limited to such fully or partially integrated structures. For example, in one embodiment of the present invention the upper chest and shoulder support platform and the lumbar support platform are held with their upper surfaces at desired elevations by a supporting framework interconnecting the platforms.

In effect, and in contrast to structures which serve to retain the back or spine in a natural position, the torso support of the present invention serves to provide a mild stretch of the user's back or decompression of the user's spine. The upper chest and shoulder support platform and the lumbar support platform will together act against the weight of a user's prone and relaxed body to cause the inside curves of thoracic and lumbar vertebrae to decompress thereby mitigating against the accumulated strain of spinal compression forces. It may be noted that a mild stretch is not the natural condition of the back.

As a general observation, it may be noted that the length of an adult torso, as represented by the individual's chest and lumbar regions, will typically not vary by more than about 1 to 3 inches (2.5 to 7.6 cm.) from one individual to the next. This tends to be so whether the individuals are tall or short, male or female. Thus, while there may be exceptions, a torso support which is sized to accommodate the needs of one typical adult user will also accommodate the needs of many others. Nevertheless, it is recognized that adjustment to accommodate the differing preferences of different individual's will be desirable in some cases. To that end, a torso support in accordance with the present invention may advantageously include means to adjust the longitudinal distance between the upper chest and shoulder support platform and the lumbar support platform.

Advantageously, a torso support in accordance with the present invention may have a double-sided or reversible construction that, when used on one side, satisfies one set of comfort criteria and, when used on an opposed side, satisfies another set of comfort criteria. For example, one side may provide a first longitudinal distance between the upper chest and shoulder support platform and the lumbar support platform. The opposed side may provide a second such distance. As another example, one side may provide a relatively deep open region between the upper chest and shoulder support platform and the lumbar support platform. The other side may provide a relatively shallow open region.

Of course, it is not merely the user's back vertebrae but also the user's neck vertebrae which may be subject to stress and strain. Without a suitable head support, the torso support described above may not serve to adequately relieve the neck area. Accordingly, in another aspect of the present invention there is provided a head support positionable on an underlying surface for supporting the head of a human body in a downwardly facing position while the torso is supported in a prone position. The head support comprises a front portion for providing lifting support to the forehead of the body, and parallel opposed side portions for concurrently providing lifting support to opposed sides of the face of the body. Each side portion extends from the front portion of the head support to a distal end. As well, each side portion has an upper surface that slopes upwardly from the front portion of the head support to the associated distal end of the side portion.

In relation to the torso support described above, the head support preferably is sized to support the user's head at a position where the neck and head tilt forwardly and downwardly to the head support when the upper chest and shoulders are supported by the upper chest and shoulder support platform. An appropriate slope on the side portions will allow the user's face to be supported not only across the forehead but also for a maximized distance along the sides of the face when the neck and head are extended forwardly and downwardly from the torso support. The forward and downward tilt of the head and neck corresponds to an inward tuck of the user's chin which facilitates a mild stretch of cervical vertebrae in the neck.

When the user's neck and head are extended forwardly and downwardly in the foregoing manner, some discomfort may arise if the user's throat moves into contact with the torso support. To avoid such discomfort, the front end of the torso support may advantageously include a notch centrally disposed widthwise for permitting the neck and head to extend downwardly and forwardly without the occurrence of such contact. In cases where the distal ends of the side portions of the head support are effectively in abutment with the torso support, then such a notch may also serve to better facilitate breathing and ventilation.

If it is desired to more easily accommodate different individuals, then the spacing of the head support away from the torso support should not be fixed. Similarly, the elevation should not be fixed. Unlike overall torso lengths which tend to vary a relatively small amount between typical adult users, there can be significant differences in neck lengths. Thus, for one user it may be desirable to position the head support further away from or closer to the torso support and/or at a different height than for another user. These points are advantageously addressed by fabricating the head and torso supports as separate rather than integral pieces. Then, the distance between the supports can be adjusted by simple longitudinal movement of the head support relative to the torso support. Further, the elevation of the head support may be easily varied by positioning one or more vertical spacers beneath the head support (or by removing such spacers).

To further advantage, one or more vertical spacers for the head support may be made wedge shaped, in effect permitting the slope of the upper surface of the head support to be adjusted together with the elevation of the head support. Such adjustability is considered desirable because a slope which is considered comfortable by one user may be considered somewhat uncomfortable by another.

The foregoing and other features and advantages of the present invention will now be described with reference to the drawings.

DETAILED DESCRIPTION OF PREFERRED EMBODIMENTS

Figure 1:
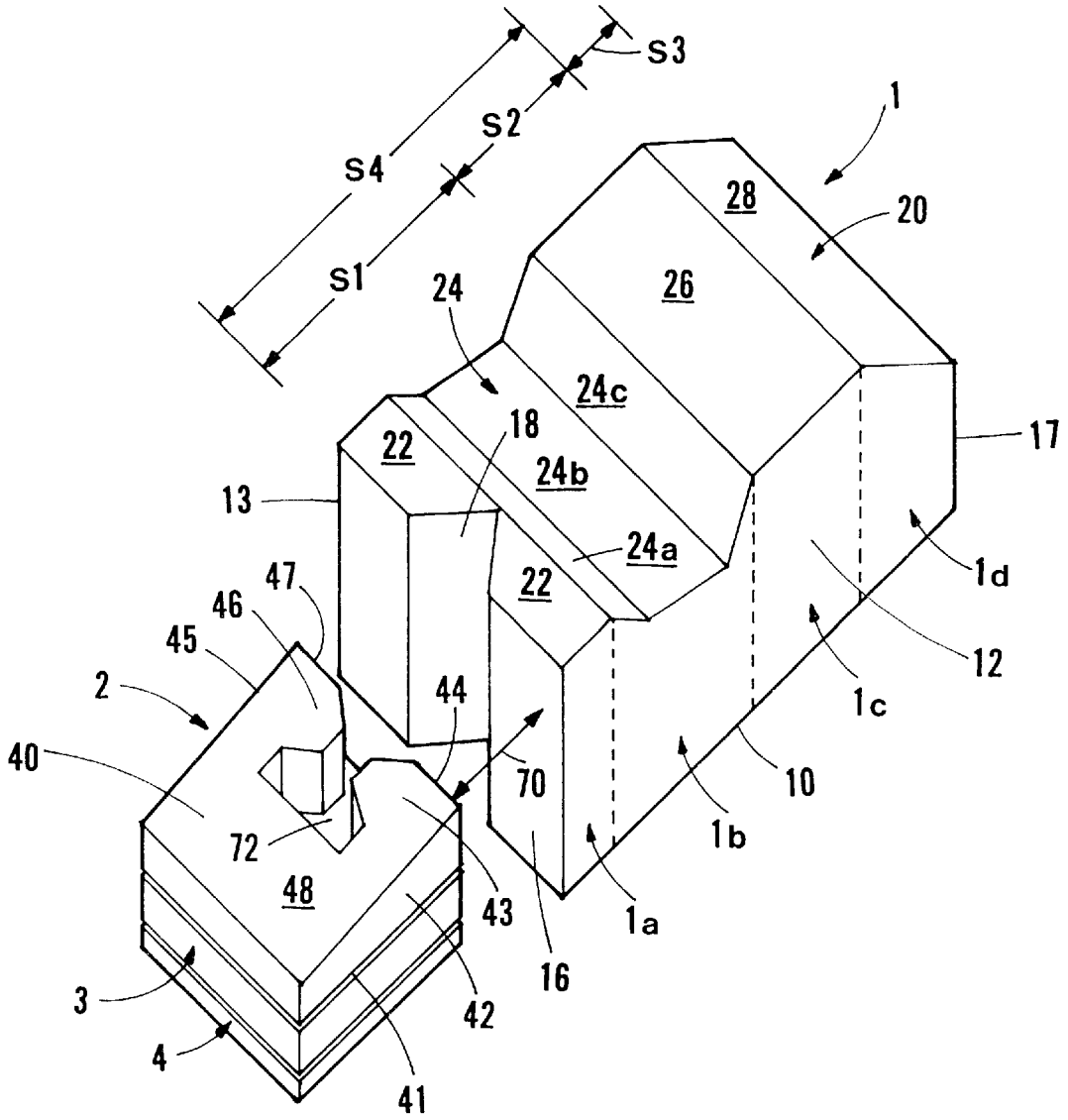
FIG. 1 is an isometric view of a torso support and a head support of a body rest structure in accordance with the present invention.
Figure 2:
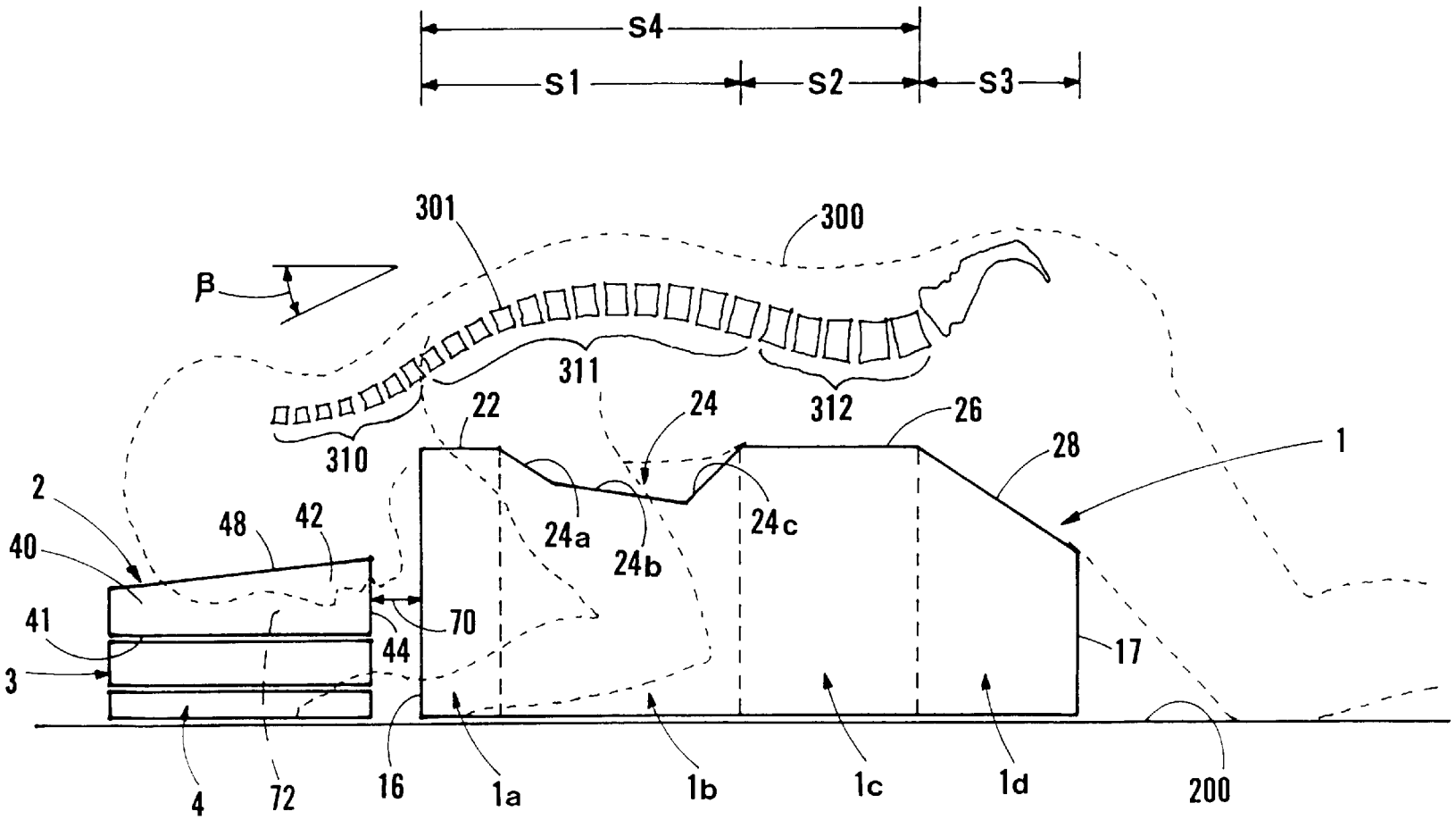
FIG. 2 is a side elevation view depicting an individual lying in a prone position on the body rest structure shown in FIG. 1.
Figure 3:
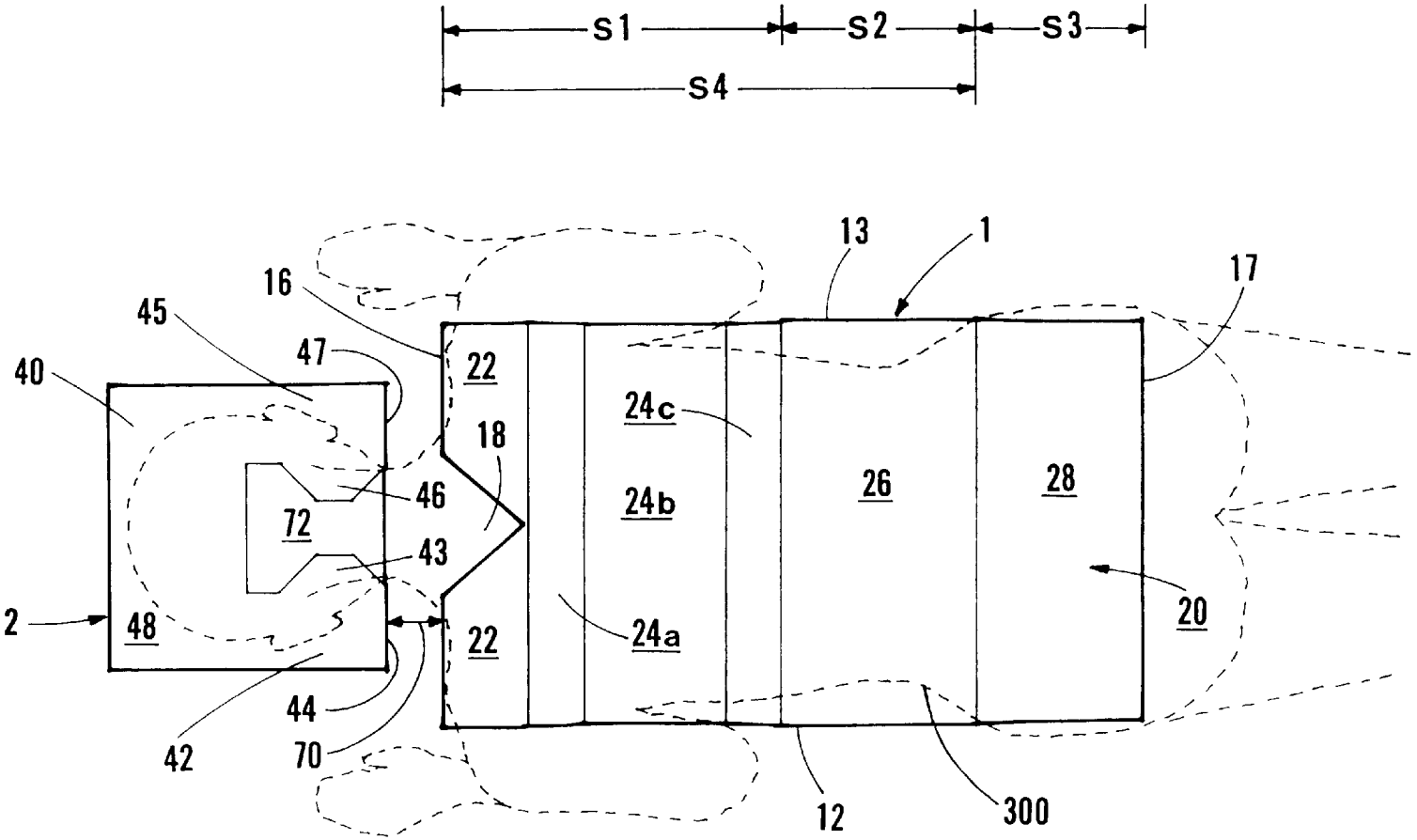
FIG. 3 is a top view depicting the individual in FIG. 2 lying in a prone position on the body rest structure shown in FIG. 1.

The body rest structure shown in FIGS. 1 to 3 includes an elongated torso support generally designated 1 and a head support comprising an upper portion generally designated 2 and vertical spacers generally designated 3, 4. FIGS. 2 and 3 additionally depict in broken outline the body (generally designated 300) of a typical adult user resting in a prone position on the structure.

Torso support 1 has an integral construction which includes a flat lower surface or base 10 for resting the support in an upright position on a flat underlying surface 200 (indicated in FIG. 2 only). Surface 200 is not considered to be a part of the invention and may be any suitable surface such as the surface of a floor or rug, a firm mattress, or the like. Further, support 1 includes an irregularly elevated upper surface generally designated 20 which extends widthwise between opposed sides 12, 13 of the support and longitudinally from front end 16 to rear end 17 of the support.

As a whole, and despite its integral construction, support 1 may be conceptually divided into four parts or blocks 1*a*, 1*b*, 1*c* and 1*d*, the dividing line between successive locks being indicated by dashed vertical lines on side 12 of support 1 in FIGS. 1 and 2.

Block 1*a* (hereinafter referred to as platform block 1*a*) provides an upper chest and shoulder support platform which includes upper surface 22 extending longitudinally from front end 16 for a relatively short distance. Block 1*c* (hereinafter referred to as platform block 1*c*) provides a lumbar support platform which includes upper surface 26. Block 1*b* provides an open region generally designated 24 between blocks 1*a* and 1*c*, the bottom of open region 24 being defined by surfaces 24*a*, 24*b* and 24*c* which together form a surface extending between upper surface 22 and upper surface 26. As best seen in FIG. 2, open region 24 is sunken below surface 22 and surface 26. Finally, block 1*d*, and in particular rear surface 28 thereof which extends longitudinally downwardly and rearwardly from surface 26 to rear end 17, provides a hip and abdomen support.

Front end 16 includes a V-shaped notch 18 centrally disposed between sides 12, 13 which permits the neck and head of body 300 to tilt forwardly and downwardly in the manner described below without the occurrence of contact between the throat of the body and torso support 1. Further, notch 18 may serve to facilitate breathing and ventilation in cases where the head support described below is positioned particularly close to front end 16. Notch 18 need not have a V-shape. It may be rectangular, semi-circular or otherwise. Further, it will be readily understood that notch 18 need not extend as shown for the full vertical distance between surface 22 and base 10 of torso support 1. However, the full extension may be preferred for ease of manufacture.

As best seen in FIGS. 2 and 3, platform block 1*a* has a width between sides 12, 13 that permits left and right arms of body 300 to extend downwardly from the shoulders over such sides. The elevation of its upper surface 22 above base 10 permits the neck and head to tilt downwardly toward the head support described below while the arms bend comfortably forward from the elbows with the hands of the body resting on surface 200. So configured, platform block 1*a* serves to mitigate against stresses which may otherwise develop in the user's arms or shoulders if the arms are constrained to extend horizontally as on a mattress or the like.

Open region 24 provides room for the weight of that part of the chest of body 300 below the shoulders (viz. the lower chest) to pull down vertically on the body between platforms blocks 1*a* and 1*c*. The bottom of region 24 defined by surfaces 24*a*, 24*b* and 24*c* while allowing such room also serves to provide some support for a user's breasts in the case of female users.

Platform block 1*c* provides significant elevation and uplifting support to body 300 from below the lumbar region of the body extending over upper surface 26. Rear supporting surface 28 of block 1*d* slopes downwardly from surface 26 to rear end 17 to provide cooperating support from below the hips and abdomen of body 300 while directing the legs of the body downwardly from platform block 1*c* and rearwardly of rear end 17. The knees of body 300 rest comfortably on surface 200.

As best apparent from FIG. 2, the combined length S1 of upper surface 22 of platform block 1*a* and open region 22 (viz. the distance from front end 16 to upper surface 26) is approximately equal to the length of the thoracic vertebrae 311 of spine 301 of body 300. Likewise, the length S2 of upper surface 26 of platform block 1*c* is approximately equal to length of the lumbar vertebrae 312 of spine 301. The horizontal length S3 of rear supporting surface 28 is approximately equal to the length of the hips and abdomen of body 300 when projected in a horizontal plane.

Torso support 1 is an integral structure formed from a relatively firm but not rigid foam material such as polyurethane. This may be done by taking a suitably sized rectangular block of foam material and cutting away necessary portions to define notch 18, open region 24 and rear supporting surface 28. If desired, the resulting foam block structure may be covered with a thin upholstery material (not shown).

In FIGS. 1 to 3, the transitions between regions 22, 24, 26 and 28, and the entire edge perimeter of upper surface 20, appear relatively sharp. If desired, such transitions and/or the edge perimeter could be made more rounded. However, this is not considered necessary. While sufficiently firm to carry the weight of a human body, suitable foam may still have a softness which avoids sources of discomfort from such transitions or the edge perimeter.

The following approximate dimensions for torso support 1 have been found to provide a very comfortable support for a typical adult user:

| | |
|---|---|
| Length of upper surface 22 measured horizontally rearward from front end 16 | about 3 inches (7.6 cm.) |
| Length of open region 24 measured horizontally between upper surface 22 and upper surface 26 | about 8 inches (20.3 cm.) |
| Combined horizontal length S1 of upper surface 22 and open region 24 | about 11 inches (27.9 cm.) |
| Length S2 of upper surface 26 | about 7 inches (17.9 cm.) |
| Horizontal length S3 of rear supporting surface 28 | about 6 inches (15.2 cm.) |
| Overall length between ends 16, 17 | about 24 inches (70 cm.) |
| Overall width between sides 12, 13 | about 15 inches (38 cm.) |
| Depth of open region 24 at its lowermost point | about 2.5 inches (6.4 cm.) |
| Elevation above base 10 of upper surfaces 22, 26 | about 10 inches (25.4 cm.) |
| Height of end 17 | about 6 inches (15.2 cm) |

As previously noted, the length of an adult torso will typically not vary by more than about 1 to 3 inches (2.5 to 7.6 cm.) from one individual to the next. In the drawings, the torso length corresponds approximately to length S4 which extends from front end 16 of torso support 1 to rear supporting surface 28. With the dimensions indicated above, length S4 (=S1+S2) works out to about 18 inches.

In use, an individual positions his or her body 300 on torso support 1 generally as shown in FIGS. 2 and 3. Preferably, the body is clothed to minimize sweating or possible soiling of the support. When so positioned, the torso receives upward lifting support on surface 22 from below the upper chest and shoulders and on surface 26 from below the body's lumbar region extending over surface 26 (viz. below lumbar vertebrae 312). Concurrently, and as noted above, the weight of the lower chest pulls down in open region 24. The effect of such upward supporting and downward pulling forces is to provide a mild longitudinal stretch on the thoracic vertebrae 311 and the lumbar vertebrae 312 of spine 301 thereby tending to relieve stress caused by earlier compression forces acting on the spine.

Just as it is desirable to relieve accumulated compression stresses on thoracic vertebrae 311 and lumbar vertebrae 312, it is also desirable to relieve accumulated compression stresses on neck or cervical vertebrae 310 (FIG. 2). As best seen in FIG. 2, torso support 1 by itself permits the neck and bead of body 300 to tilt forwardly and downwardly from the shoulders thereby serving to stretch cervical vertebrae 310. However, in the absence of a suitable head support in advance of torso support 1, the user's neck would carry the fully weight of the head. The cervical vertebrae could be overstretched—thereby substituting one form of stress or strain for another. As shown in FIGS. 1–3, a head support consisting of an upper portion 2, and two vertical spacers 3, 4 is provided to avoid the problem of such overstretch while at the same time enabling a mild stretch.

In more detail, upper portion 2 of the head support shown in FIGS. 1–3 includes a front portion 40 which is positioned to extend parallel to front end 16 of torso support 1, and parallel opposed side portions 42, 45 extending from front portion 40 to distal ends 44, 47, the latter of which ends are spaced away from front end 16 by a breathing and ventilation air gap 70 which extends transversely between the head support and torso support 1. As best seen in FIGS. 2 and 3, front portion 40 serves to provide lifting support to the forehead of body 300. Side portions 42, 45 serve to provide lifting support to opposed sides of the face of body 300 and advantageously assist to hold the users head in a downwardly facing position (viz. thereby restraining rotation about the longitudinal axis of the neck). Inwardly widened portions 43, 46 of side portions 42, 45 serve to better adapt the side portions to the facial contour of a typical user.

Upper portion 2 of the head support shown in FIGS. 1–3 includes a base 41 formed by the lower surface of front portion 40 and the lower surfaces of side portions 42, 45, and an upper surface 48 formed the upper surfaces of front portion 40 and side portions 42, 45. As best seen in FIG. 2, upper surface 48 lies below the height of upper surface 22 of torso support 1. Further, upper surface 48 slopes upwardly from front portion 40 to distal ends 44, 47. This slope better conforms the head support with the user's face while the user's chin is tucked inwardly towards front end 16 of torso support 1 in the manner shown. Note also (FIG. 2) that the height of upper surface 48 above base 41 is sufficient to elevate the face of body 300 above base 41. The result is to provide a breathing and ventilation air gap 72 between the user's face and base 41.

Upper portion 2 of the head support shown in FIGS. 1–3 and, as well, the vertical spacers described below, may be formed from polyurethane foam material like that used for torso support 1. However, because less weight is carried by the head support, a softer foam may be used and may be preferred, particularly for upper portion 2, to provide added comfort for the user. Alternately, a padded pillow type construction may be used. In any case, the foam or padding should not be so soft that the efficacy of the slope of upper surface 48 is lost.

The following approximate dimensions for upper portion 2 of the head support shown in FIGS. 1–3 have been found to provide a very comfortable head support for many typical adult users:

| | |
|---|---|
| Outer dimensions of base 41 | about 10 inches by 10 inches (25.4 cm. by 25.4 cm.) |
| Height above base 41 at top end of front portion 40 | about 2 inches (5.1 cm.) |
| Height above base 41 at distal ends 44, 47 | about 3 inches (7.6 cm.) |
| Inner width at forehead position (viz. eye space) | about 5 inches (12.7 cm.) |
| Inner width at inwardly widened regions 43, 46 (viz. nose space) | about 2 inches (5.1 cm.) |
| Inner length from distal ends 44, 47 to inner side of front portion 40 | about 5.5 inches (14 cm.) |

If upper portion 2 with the foregoing dimensions is placed with its base 41 directly atop surface 200 shown in FIG. 2, then its upper surface 48 will be distanced relatively far below the elevation of upper surface 22 of torso support 1. While this will be comfortable for many users, others may find that the neck is uncomfortably extended. The cervical vertebrae 310 may be overstretched before the head reaches and receives any support from the head support. Also, the efficacy of the slope of upper surface 48 may be largely lost. Ultimately, the degree of comfort or discomfort will depend upon the user's neck length and facial structure.

In order to provide a desired mild stretch while avoiding an overstretch to the user's cervical vertebrae 310, it is presently considered that upper portion 2 of the head support should be positioned such that the user's neck and head tilt forwardly and downwardly from the shoulders at an angle β (see FIG. 2) of at least 10 to 20 degrees, but preferably not more than about 30 to 35 degrees. Below 10 to 20 degrees, but depending upon the individual, it becomes doubtful that any significant stretch would be achieved. Above 30 to 35 degrees, it becomes more likely that an overstretch will result, particularly if the position is held for an extended period of time. Depending upon neck length, facial structure and the natural posture of the user, such positioning may require that the head support be moved longitudinally a greater or lesser distance from front end 16 of torso support 1 than is indicated in the FIGS. 1 to 3. As well, such positioning may require that the head support have an effective height greater than that which would be achieved if upper portion 2 with the foregoing specific dimensions was placed directly atop surface 200 shown in FIG. 2.

Of course, added height may be achieved simply by fabricating upper portion 2 of the head support with more distance between its base 41 and its upper surface 48 than is indicated in FIGS. 1, 2. However, the support would then be unsuitable for individuals who may prefer a lower height. Further, and apart from height preferences, the comfort of some individuals may recommend that the slope of upper surface 48 be varied.

To better accommodate the needs of different individuals, it is preferred to fabricate an upper portion 2 with a relatively low height per se and to provide one or more vertical spacers which may be selectively placed below base 41 to elevate the overall height of the head support to a desired level. By way of example, the use of two rectangular block spacers generally designated 3, 4 is shown in FIGS. 1–2. Widthwise and lengthwise, the dimensions of spacers 3, 4 are substantially the same as upper portion 2. The height of spacer 3 is about double that of spacer 4 and, together, they serve to approximately double the overall height of the head support. Significant variation in overall height can be achieved by selectively using one or other of such spacers, or both, or neither.

Figure 9:
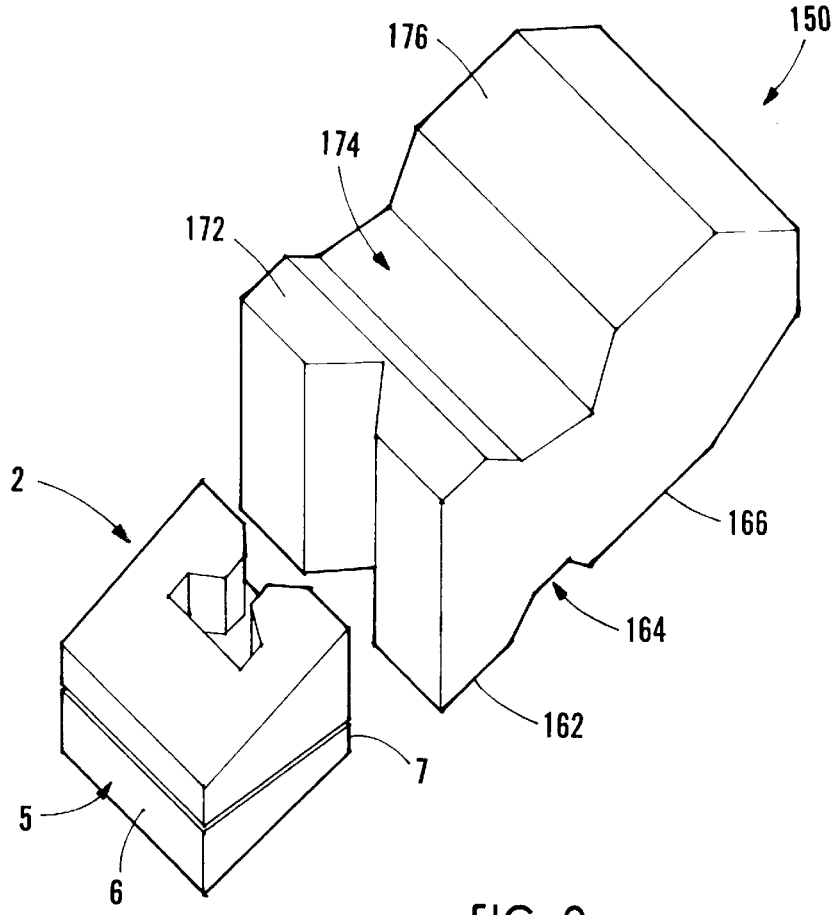
FIG. 9 is an isometric view of a double-sided or reversible torso support in accordance with the present invention, together with a head support utilizing a wedge shaped vertical spacer.

Of course, rectangular block spacers 3, 4 merely permit adjustment to the overall height of the head support. They do not permit adjustment to the slope of the upper surface of the head support (viz. upper surface 48 of upper portion 2). However, as illustrated by way of example with the embodiment shown in FIG. 9, a wedge shaped vertical spacer 5 used in conjunction with upper portion 2 shown in FIGS. 1–3 will serve the latter purpose. Spacer 5 includes a leading side 6 and an opposed trailing side 7. The height of side 6 is higher than that of side 7. Accordingly, when upper portion 2 is placed atop spacer 5 as shown in FIG. 9, then the slope of upper surface 48 is necessarily reduced. Obviously, spacer 5 may be used to increase the slope of upper surface 48 merely by a 180° rotation beneath upper portion 2.

To best accommodate the variable but unknown head support preferences of a variety of users, it will be understood that a head support in accordance with the present invention will ideally include an upper portion such as upper portion 2 together with one or more rectangular block vertical spacers and one or more wedge shaped vertical spacers. The user then has the opportunity to try different combinations of spacers and to select the combination that he or she finds most comfortable.

The specific dimensions indicated above are not intended to limiting. Rather, they are preferred dimensions to enable the body rest structure to comfortably accommodate an average adult user. However, in the case of children (who are less likely to suffer from back strain in the first place), and in the case of some adult users, it will be understood that differing dimensions may be found equally or more suitable.

Figure 4:
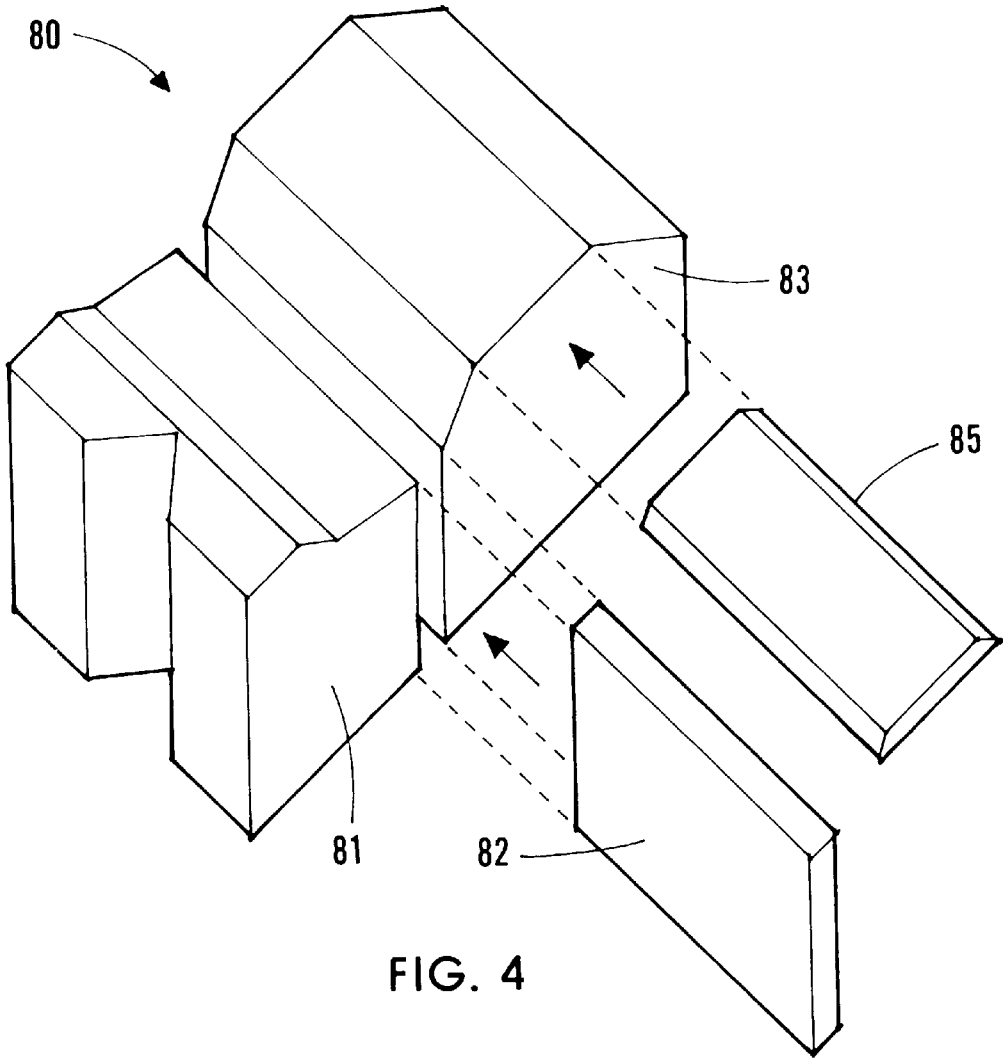
FIG. 4 is an exploded isometric view of a segmented torso support in accordance with the present invention.
Figure 5:
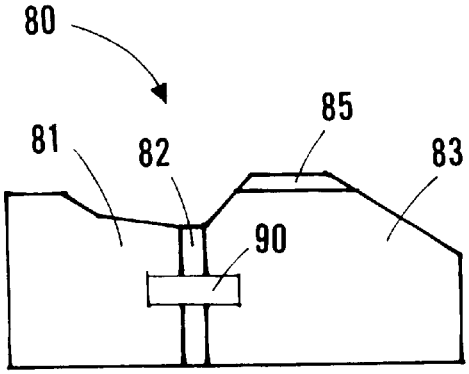
FIG. 5 is a side elevation view of the torso support shown in FIG. 4.

While an integral structure having the dimensions indicated above for torso support 1 will provide suitable support for a broad range of different individuals, it is nevertheless contemplated that at least some adjustability in the torso support will be preferred in some cases. This is particularly so with respect to the overall length of the support and with respect to the elevation provided by the lumbar support region (surface 26) of the support. The torso support generally designated 80 which is shown in FIGS. 4 and 5 allows for limited adjustment of both such overall length and such elevation.

Torso support 80 includes a forward part 81, a middle part 82, and a rearward part 83. As well, torso support 80 includes a spacer 85 which may be optionally positioned atop rearward part 83 to effectively increase the elevation of a user's lumbar region, hips and abdomen. When all such parts are in use, they will normally be assembled in the manner shown in FIG. 5.

When assembled, torso support 80 has all the basic attributes of torso support 1. However, its overall length can be varied or adjusted by substituting one or more different middle parts 82 having more or less combined thickness than the thickness of part 82 as depicted in FIGS. 4 and 5. Or, to achieve a minimal overall length, forward and rearward parts 81, 83 can be moved into direct abutment contact with each other as shown in FIG. 6 thereby defining a shorter torso support 80*a* which also has all the basic attributes of torso support 1, but which includes no intervening middle part 82.

If parts 81 and 83 are designed with a combined length of about 23 inches (58.4 cm.), and if two rectangular block parts 82 are provided, one having a thickness of about 1 inch (2.5 cm.), the other having a thickness of about 2 inches (5.1 cm) then overall length can be adjusted in discrete steps from about 23 inches (58.4 cm.) to about 26 inches (66 cm.). This range of adjustment recognizes the variations between individuals in the length of a typical adult torso. While a torso support having a non-adjustable length can be adequate for a great many cases, some individuals may be relatively sensitive and may find one length discernably more comfortable than another. A provision for length adjustment will serve to better accommodate individual preferences.

Figure 6:
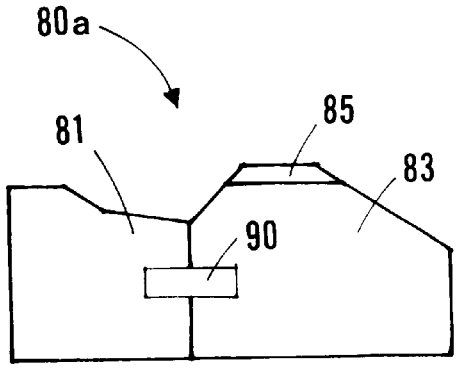
FIG. 6 is a side elevation view of a torso support which omits a middle part of the torso support shown in FIG. 5.

When parts 81, 82, 83 or parts 81, 83 are assembled in the manner shown in FIG. 5 or FIG. 6, the assembly normally will be quite stable without the need to fasten the parts. However, if desired, added stability can be achieved by a simple fastening means such as a suitable VELCRO® fastener or removable tape extending between parts 81 and 83 as indicated by element 90 in FIGS. 5 and 6.

The use of spacer 85 is also a matter of individual preference. When spacer 85 is not used, then torso support 80 or 80*a* (as the case may be), will elevate the user's upper chest, shoulders and lumbar region all to about the same level. The same is true in the case of torso support 1 where, as best seen in FIG. 2, the upper chest, shoulders and lumbar region of body 300 are all supported at basically the same elevation. Here, it also may be noted that a spacer such as spacer 85 could also be used in conjunction with torso support 1 just as it may be used in conjunction with torso support 80 or 80*a*.

When spacer 85 is used, then the lumbar region of a user's body will be elevated to a slightly higher level than his or her upper chest and shoulders. In effect, a stronger stretching force is applied to the user's spinal vertebrae than if the lumbar region, chest and shoulder's were all elevated to the same level. Such a spacer will be desirable in some cases because some user's may find that the relatively higher elevation serves more effectively to relieve the stress caused by earlier compression forces acting on the spine. However, the added elevation should not be excessive. Otherwise, the desired mild stretch that otherwise would be applied to the spinal vertebrae may become an over stretch substituting one form of back discomfort for another. Preferably, the added elevation provided by the thickness of spacer 85 should be limited to no more than about 1½ inches (3.8 cm.).

It will be understood that a torso support in accordance with the present invention also may be designed to support the upper chest and shoulders at an elevation higher than that of the lumbar region. Some individuals may find such a design (not shown) to be somewhat more comfortable. However, so as not to impose the design on all individuals who may have occasion to use a given torso support, it is contemplated that such added elevation for the upper chest and shoulders may best be provided by an optional spacer (not shown) similar to spacer 85 shown in FIGS. 4 to 6, but modified to fit atop the forward end of the support (including a suitable notch as discussed above in relation to torso support 1 to accommodate the user's throat).

Figure 7:
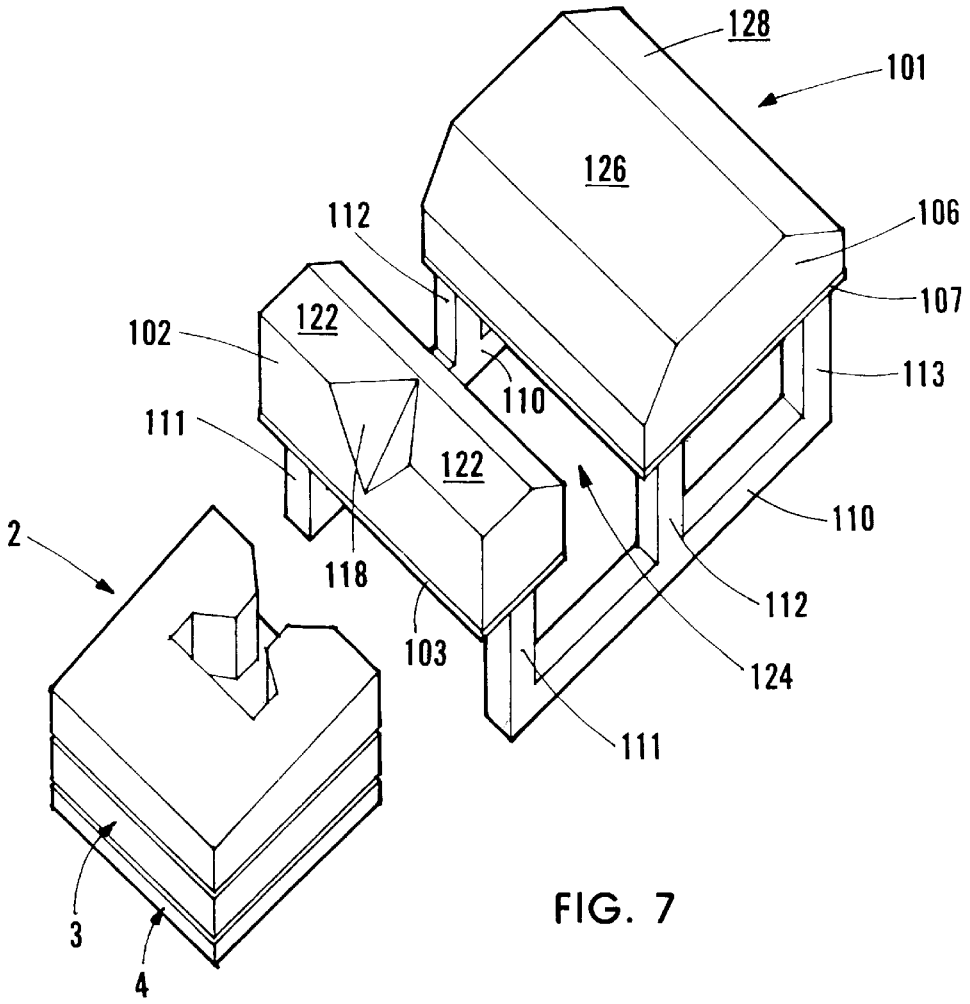
FIG. 7 is an isometric view of a framework style torso support in accordance with the present invention, together with the head support shown in FIG. 1.
Figure 8:
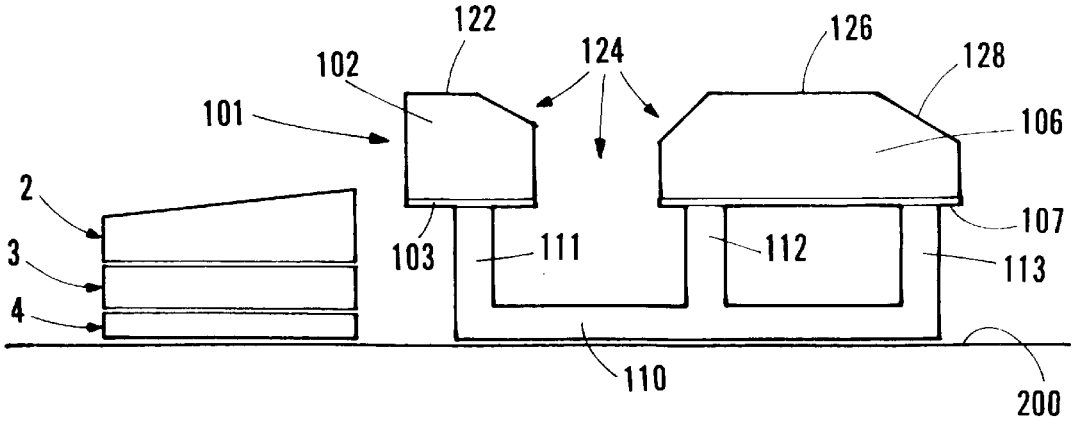
FIG. 8 is a side elevation view of the torso support and head support shown in FIG. 7.

Referring now to FIGS. 7 and 8, there is shown a body rest structure in accordance with the present invention which comprises a torso support generally designated 101 including an upper chest and shoulder support platform 102 having an upper surface 122, a lumbar support platform 106 having an upper surface 126, and a supporting framework which interconnects the platforms and serves as a means for holding the platforms with their surfaces 122, 126 elevated above underlying surface 200 (shown in FIG. 8 only). An open region generally designated 124 extends between platforms 102, 106. The body rest structure shown in FIGS. 7 and 8 also includes a head support which is the same as the head support described above in relation to FIGS. 1 to 3.

Platform 102 is formed from polyurethane foam secured atop a rigid underlying sheet 103 of plywood or the like to provide upper chest and shoulder support. It may be considered that upper surface 122 of platform 102 has the same elevation and the same overall longitudinal and widthwise dimensions as upper surface 22 of platform block 1*a* of torso support 1. Note also that platform 102 includes a centrally disposed notch 118. This notch is generally equivalent to notch 18 in platform block 1*a* torso support 1.

Platform 106 is formed from polyurethane foam secured atop a rigid underlying sheet 107 to provide lumbar support. It may be considered that upper surface 126 of platform 106 has the same elevation and the same overall longitudinal and widthwise dimensions as upper surface 26 of platform block 1*c* of torso support 1. Note also that an integrally formed rear supporting surface 128 extends downwardly and rearwardly from upper surface 126. This surface serves to provide hip and abdomen support and is generally equivalent to rear supporting surface 28 of block 1*d* of torso support 1.

Open region 124 of torso support 101 provides a longitudinal distance between upper surface 122 of platform 102 and upper surface 126 of platform 106 which is basically the same as the longitudinal distance between upper surface 22 and upper surface 26 of torso support 1. As such, it provides room for the weight of a user's chest below the shoulders to pull down vertically on the body between the platforms.

The supporting framework for torso support 101 is fabricated from rectangular aluminum tubing comprising, on each side of the support, a longitudinally extending base member 110 and upright members 111, 112, 113. Sheet 103 which carries platform 102 is secured to upright members 111. Sheet 107 which carries platform 106 is secured to upright members 112, 113. It will be readily apparent to those skilled in the art that the overall length of torso support 101, and particularly the distance between platforms 102 and 106, may be made adjustable by splitting base members 110 and sizing forward and rearward portions thereof such that one portion is allowed to adjustably telescope within the other.

Generally, torso support 101 is more rugged and durable than torso support 1 or torso support 80. However, it also has a more clinical appearance and may be considered aesthetically less pleasing for home use. Further, torso support 101 may also be more expensive to manufacture and some female users may consider it to be less comfortable because open region 124 of torso support 101 lacks a bottom surface portion which is the equivalent of surface 24*b* of torso support 1.

Figure 10:
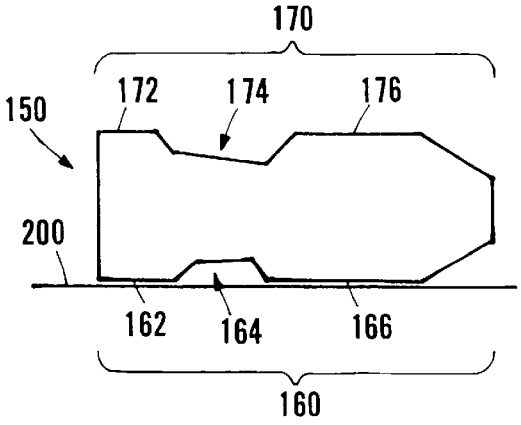
FIG. 10 is a side elevation view of the torso support shown in FIG. 9.
Figure 11:
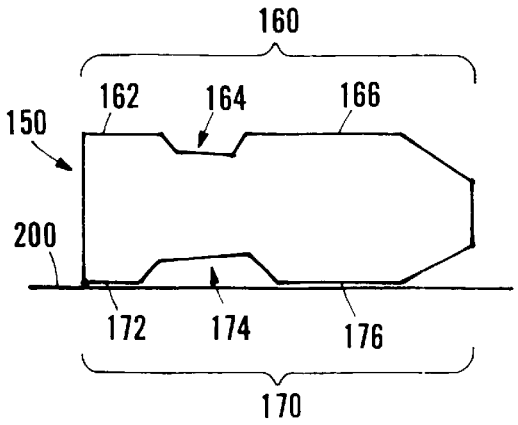
FIG. 11 is a side elevation view of the torso support shown in FIG. 9, but with the positions of its top and bottom sides reversed.

Referring now to the embodiment depicted in FIGS. 9 to 11, there is shown a body rest structure comprising a torso support generally designated 150 and a head support. The head support (shown only in FIG. 9) is made with an upper portion 2 and a wedge shaped vertical spacer 5 as described above. Generally, the construction of torso support 150 is very similar to that of torso support 1 described above, but with differences as noted below.

In more detail, and as shown in FIGS. 10 and 11, torso support 150 includes a first side generally designated 160 and an opposed second side generally designated 170. In FIG. 10, first side 160 is on the bottom and is positioned on underlying surface 200. Second side 170 in on the top. However, in FIG. 11, the positions have been reversed by flipping the support 180° on its longitudinal axis thereby placing first side 160 on the top and second side 170 on the bottom.

When first side 160 is positioned on surface 200 as shown in FIG. 10, then second side 170 is defined by a first platform 172 for providing lifting support from below the upper chest and shoulders of a user's body (not shown) and a second platform 176 for providing cooperating lifting support from below the lumbar vertebrae of the body. An open region generally designated 174 extends longitudinally between platforms 172, 176.

Conversely, when second side 170 is positioned on surface 200 as shown in FIG. 11, then first side 160, now on top, is defined by a third platform 162 for providing lifting support from below the upper chest and shoulders of the user's body and a fourth platform 166 for providing cooperating lifting support from below the lumbar vertebrae of the body. An open region generally designated 164 extends longitudinally between platforms 162, 166.

The overall length, height and width of torso support 150 is essentially the same as that of torso support 1. Similarly, the surface area of platforms 172 and 176 are essentially the same as those of upper surfaces 22 and 26, respectively, of torso support 1. Likewise, the size of open region 174 is essentially the same as that of open region 24 of torso support 1. However, the surface areas of platforms 162 and 166 are greater than those of platforms 172 and 176, respectively, and the size of open region 164, including a shallower depression, is smaller than that of open region 174. Thus, when torso support 150 is flipped 180° from the position shown in FIGS. 9 and 10 to the position shown in FIG. 11, the support characteristics will be altered.

In use, a user may select side 160 or side 170 of torso support 1 to be used as the top or bottom side of torso support 150. When side 160 is used on the bottom as shown in FIGS. 9 and 10, then torso support 150 will provide the same support characteristics as torso support 1. However, if the resulting stretch on the user's back is uncomfortable, then the user may elect to use side 170 on the bottom as shown in FIG. 11. Then, the body will receive additional underlying support by reason of the larger surface areas of platforms 162 and 166, and the smaller size of open region 174.

In the embodiment shown in FIG. 9 to 11, the elevations of platforms 172 and 176 or platforms 162 and 166 (as the case may be depending upon which side 160 or 170 of torso support 150 in on top) are substantially equal. However, it will be understood that this is not essentially so. Some or all of such elevations may differ. For example, such elevations may be altered with the use of a spacer such as spacer 85 described above in relation to FIG. 4.

Various modifications and changes can be made to the form, details, arrangement, size and proportion of the various parts described above with reference to the foregoing embodiments without departing from the scope of the present invention. The invention is not to be construed as limited to the particular embodiments which have been described and should be understood as encompassing all those embodiments which are within the spirit and scope of the claims which follow.

I claim:

1. A body rest structure comprising a longitudinally extending torso support for supporting the torso of a human body in a prone position elevated above an underlying surface, said torso support including first and second sides selectively positionable on said surface, wherein:

(a) when said first side is positioned on said surface, said second side is defined by:

(i) a first platform for providing lifting support from below the upper chest and shoulders of said body at a first predetermined elevation above said surface;

(ii) a second platform for providing cooperating lifting support only from below the lumbar vertebrae of said body at a second predetermined elevation above said surface; and, (iii) an open region extending longitudinally between said first and second platforms for providing room for at least a portion of the weight of the chest of said body below said shoulders to pull down on said body between said first and second platforms;

said first and second platforms and said open region being sized to enable a longitudinal stretch of both the thoracic vertebrae and the lumbar vertebrae of said body when said body is positioned on said first and second platforms; and concurrently, said first platform permitting the neck and head of said body to tilt forwardly and downwardly from said shoulders to a tucked chin position enabling a longitudinal stretch of the cervical vertebrae of the body;

(b) when said second side is positioned on said underlying surface, said first side is defined by:

(i) a third platform for providing lifting support from below the upper chest and shoulders of said body at a third predetermined elevation above said surface;

(ii) a fourth platform for providing cooperating lifting support from below the lumbar vertebrae of said body at a fourth predetermined elevation above said surface; and, (iii) an open region extending longitudinally between said third and fourth platforms for providing room for at least a portion of the weight of the chest of said body below said shoulders to pull down on said body between said third and fourth platforms; and, (c) the longitudinal extension of said open region between said first and second platforms defined when said first side is positioned on said surface is greater than the longitudinal extension of said open region between said third and fourth platforms defined when said second side is positioned on said surface.

2. A body rest structure as defined in claim 1, wherein said first, second, third and fourth predetermined elevations are substantially equal.

3. A body rest structure comprising a torso support extending longitudinally from a front end to a rear end for supporting the torso of a human body in a prone position elevated above an underlying surface, said torso support comprising:

(a) an upper chest and shoulder support platform having an upper surface extending longitudinally from said front end for a relatively short distance for providing lifting support from below the upper chest and shoulders of said body, said platform having a width between opposed longitudinally extending sides of said platform, said width being sized for permitting left and right arms of said body to concurrently extend downwardly from said upper surface over associated ones of said sides when said upper chest and shoulders are supported as aforesaid;

(b) means for holding said upper chest and shoulder support platform with its said upper surface at an elevation above said underlying surface such that, when said upper chest and shoulders are supported as aforesaid;

(c) a lumbar support platform spaced longitudinally rearwardly from said upper chest and shoulder support platform and having a longitudinally extending upper surface for providing lifting support to said body only from below the lumbar vertebrae of said body, said upper surface of said lumbar support platform extending longitudinally for a limited distance permitting left and right legs of said body to extend downwardly from said lumbar support platform and longitudinally rearwardly of said rear end;

(d) means for holding said lumbar support platform with its said upper surface at an elevation above said underlying surface such that, when said region below the lumbar vertebrae is supported as aforesaid, said elevation permits the knees of said body to rest on said underlying surface without carrying a substantial part of the weight of said legs above said knees; and, (e) an open region extending longitudinally between said platforms for providing room for at least a portion of the weight of the chest of said body below said shoulders to pull down on said body between said platforms; said platforms and said open region being sized to enable a longitudinal stretch of both the thoracic vertebrae and the lumbar vertebrae of said body when said body is positioned on said platforms; and, concurrently, said upper chest and shoulder support platform perimitting the neck and head of said body to tilt forwardly and downwardly form said shoulders to a tucked chin position enabling a longitudinal stretch of the cervical vertebrae of the body.

4. A body rest structure as defined in claim 3, wherein said elevation of said lumbar support platform is approximately the same as the elevation of said upper chest and shoulder support platform.

5. A body rest structure as defined in claim 3, wherein said elevation of said lumbar support platform is greater than the elevation of said upper chest and shoulder support platform.

6. A body rest structure as defined in claim 3, including means for adjusting the longitudinal distance between said platforms.

7. A body rest structure as defined in claim 3, wherein said means for holding said platforms comprises a supporting framework interconnecting said platforms.

8. A body rest structure as defined in claim 3 wherein said front end of said torso support includes a notch centrally disposed widthwise for permitting the neck and head of said body to extend downwardly and forwardly as aforesaid without the occurrence of contact between the throat of said body and said torso support.

9. A body rest structure as defined in claim 3, wherein said open region has a bottom defined by an upper surface extending between said upper surface of said upper chest and shoulder support platform and said upper surface of said lumbar support platform, at least a substantial portion of said defining surface extending longitudinally rearwardly from said upper surface of said upper chest and shoulder support below said elevation of said upper surface of said upper chest and shoulder support platform.

10. A body rest structure as defined in claim 9, said torso support including a rear supporting surface extending downwardly and rearwardly from said upper surface of said lumbar support platform to said rear end, said supporting surface for providing lifting support from below the hips and abdomen of said body while directing said legs downwardly from said lumbar support platform and longitudinally rearwardly of said rear end.

11. A body rest structure as defined in claim 10, wherein said platforms, said means for holding said platforms, said defining surface and said rear supporting surface are integrally formed.

12. A body rest structure as defined in claim 3 further including a head support positionable on said underlying surface forward of said front end of said torso support for supporting said head of said body in a downwardly facing position above said underlying surface, said head support comprising:

(a) a front portion for providing lifting support to the forehead of said body; and, (b) parallel opposed side portions for concurrently providing lifting support to opposed sides of the face of said body, each side portion extending from said front portion to an associated distal end.

13. A body rest structure as defined in claim 12 wherein said head support is sized for supporting said head at a position where said neck and head of said body tilt forwardly and downwardly from said shoulders at an angle in the range of about 20 to 35 degrees to said head support when said upper chest and shoulders are supported as aforesaid by said upper chest and shoulder support platform.

14. A body rest structure as defined in claim 12, said head support further including a vertical spacer removably positionable beneath said front portion and said side portions of said head support for elevating said portions.

15. A body rest structure as defined in claim 14, wherein said vertical spacer is wedge shaped.

16. A body rest structure as defined in claim 12, wherein each of said side portions has an upper surface that slopes upwardly from said front portion to its associated distal end.

17. A body rest structure as defined in claim 16, further including a vertical spacer positionable beneath said front portion and said side portions for elevating said portions.

18. A body rest structure as defined in claim 17, wherein said vertical spacer is wedge shaped.

19. A head support positionable on an underlying surface for supporting the head of a human body in a downwardly facing position above said surface while the torso of said body is supported in a prone position above said surface, said head support comprising:

(a) a front portion for providing lifting support to the forehead of said body;

(b) parallel opposed side portions for concurrently providing lifting support to opposed sides of the face of said body; each side portion extending from said front portion to an associated distal end; each side portion having an upper surface that slopes upwardly from said front portion to its associated distal end; and, (c) a wedge shaped vertical spacer removably positionable beneath said front portion and said side portions of said head support for elevating said upper surfaces, and (i) in a first selected position, to concurrently decrease said upward slope of said surfaces, and (ii) in a second selected position, to concurrently increase said upward slope of said surfaces.

* * * * *